US008733298B2

(12) United States Patent
Haskara et al.

(10) Patent No.: US 8,733,298 B2
(45) Date of Patent: May 27, 2014

(54) METHOD AND APPARATUS FOR OPERATING A COMPRESSION IGNITION ENGINE

(75) Inventors: Ibrahim Haskara, Macomb, MI (US); Yue-Yun Wang, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 954 days.

(21) Appl. No.: 12/850,112

(22) Filed: Aug. 4, 2010

(65) Prior Publication Data

US 2012/0031384 A1 Feb. 9, 2012

(51) Int. Cl.
*F02D 41/00* (2006.01)

(52) U.S. Cl.
USPC ..... 123/1 A; 123/698; 123/575; 123/435

(58) Field of Classification Search
USPC ..... 123/1 A, 435, 672, 690, 698, 699, 575
See application file for complete search history.

(56) References Cited

U.S. PATENT DOCUMENTS

| | | | | |
|---|---|---|---|---|
| 4,942,848 | A * | 7/1990 | Terasaka | 123/1 A |
| 5,092,305 | A * | 3/1992 | King | 123/575 |
| 5,195,497 | A * | 3/1993 | Yoshida et al. | 123/696 |
| 5,419,296 | A * | 5/1995 | Yamaura | 123/435 |
| 5,467,755 | A * | 11/1995 | Konrad et al. | 123/674 |
| 7,305,939 | B2 * | 12/2007 | Carlson | 123/27 GE |
| 7,404,397 | B2 * | 7/2008 | Dobeck | 123/672 |
| 7,533,660 | B2 * | 5/2009 | Serra et al. | 123/575 |
| 7,946,280 | B2 * | 5/2011 | Wolber et al. | 123/575 |
| 8,136,486 | B2 * | 3/2012 | von Beck | 123/1 A |
| 2008/0091334 | A1 * | 4/2008 | Carlson et al. | 701/105 |
| 2008/0167786 | A1 | 7/2008 | Sasaki et al. | |
| 2009/0024303 | A1 * | 1/2009 | Schneider et al. | 701/103 |
| 2009/0178474 | A1 * | 7/2009 | Bailey | 73/114.38 |
| 2010/0235073 | A1 * | 9/2010 | Pontoppidan et al. | 701/106 |
| 2011/0093181 | A1 * | 4/2011 | Ciaravino et al. | 701/102 |
| 2011/0208409 | A1 * | 8/2011 | Snyder et al. | 701/109 |

* cited by examiner

*Primary Examiner* — Thomas Moulis

(57) ABSTRACT

A method for operating an internal combustion engine includes monitoring oxygen concentration in an exhaust gas feedstream, a mass flowrate of intake air, and a commanded fuel pulse of fuel. A blend ratio of biodiesel fuel and petrodiesel fuel of the fuel is determined. Engine operation is controlled in response to the blend ratio of biodiesel fuel and petrodiesel fuel of the fuel.

18 Claims, 3 Drawing Sheets

METHOD AND APPARATUS FOR OPERATING A COMPRESSION IGNITION ENGINE

TECHNICAL FIELD

This disclosure is related to internal combustion engines, including compression-ignition engines configured to operate using a blend of petrodiesel and biodiesel fuels.

BACKGROUND

The statements in this section merely provide background information related to the present disclosure and may not constitute prior art.

Internal combustion engines including compression-ignition engines use fuel that originates from raw stocks including petroleum, referred to as petrodiesel fuel, and raw stocks including biological sources, referred to as biodiesel fuel. Fuel suppliers may provide fuels that have varying mixes and blends of petrodiesel fuel and biodiesel fuel.

Petrodiesel fuel originates from the fractional distillation of crude oil and is a mixture of carbon chains that typically contain between 8 and 21 carbon atoms per molecule. It is known that biodiesel fuel refers to a vegetable oil-based or animal fat-based diesel fuel consisting of long-chain alkyl (i.e., methyl, propyl, or ethyl) esters. Suitable vegetable oil-based feedstocks include soy, rapeseed, and jatropha. Biodiesel fuel may be made by chemically reacting lipids (e.g. vegetable oil, animal fat) with an alcohol.

Fuel may be characterized in terms of a lower heating value ($Q_{LHV}$), which is a chemical energy content of the fuel per unit mass. It is known that different fuels and fuel blends have different heating values ($Q_{LHV}$) and stoichiometric air/fuel ratios, which may affect engine operation and engine performance. A stoichiometric air/fuel ratio is a mixture of air and fuel that has a ratio, measured in mass/mass or other suitable measurement that is sufficient to achieve complete combustion of the fuel and no more.

Known biodiesel fuels have a stoichiometric air/fuel ratio of around 12.46:1 and known petrodiesel fuels have a stoichiometric air/fuel ratio of around 14.5:1. Known biodiesel fuels have densities around 0.8857 kg/L and known petrodiesel fuels have densities around 0.8474 kg/L. Known biodiesel fuels have heating values ($Q_{LHV}$) of the fuel around 37.277 MJ/kg and known petrodiesel fuels have heating values ($Q_{LHV}$) around 42.74 MJ/kg. Known biodiesel fuels have oxygen contents around 11.75% by weight and known petrodiesel fuels have no oxygen content. Cetane numbers for biodiesel fuels may vary from that associated with known petrodiesel fuels.

Known fuel injectors for internal combustion engines inject fuel in response to a command. A command to a fuel injector is in the form of a pulsewidth, i.e., an open time. Thus an injector delivers an amount of fuel that correlates to the open time and fuel pressure, with the amount of fuel measured in volume, e.g. milliliters, which corresponds to a mass of fuel when the density of the fuel is known and the injector is operating as intended.

SUMMARY

A method for controlling operation of an internal combustion engine configured to combust fuel in a compression-ignition combustion mode includes monitoring oxygen concentration in an exhaust gas feedstream of the internal combustion engine, mass flowrate of intake air, and a commanded fuel pulse of the fuel. A stoichiometric air/fuel ratio of the fuel is determined based on the oxygen concentration in the exhaust gas feedstream, the mass flowrate of intake air, and the commanded fuel pulse. A first blend ratio of biodiesel fuel and petrodiesel fuel of the fuel correlated to the stoichiometric air/fuel ratio of the fuel is determined. Engine operation is controlled in response to the first blend ratio of biodiesel fuel and petrodiesel fuel of the fuel.

BRIEF DESCRIPTION OF THE DRAWINGS

One or more embodiments will now be described, by way of example, with reference to the accompanying drawings, in which.

DETAILED DESCRIPTION

Figure 1:
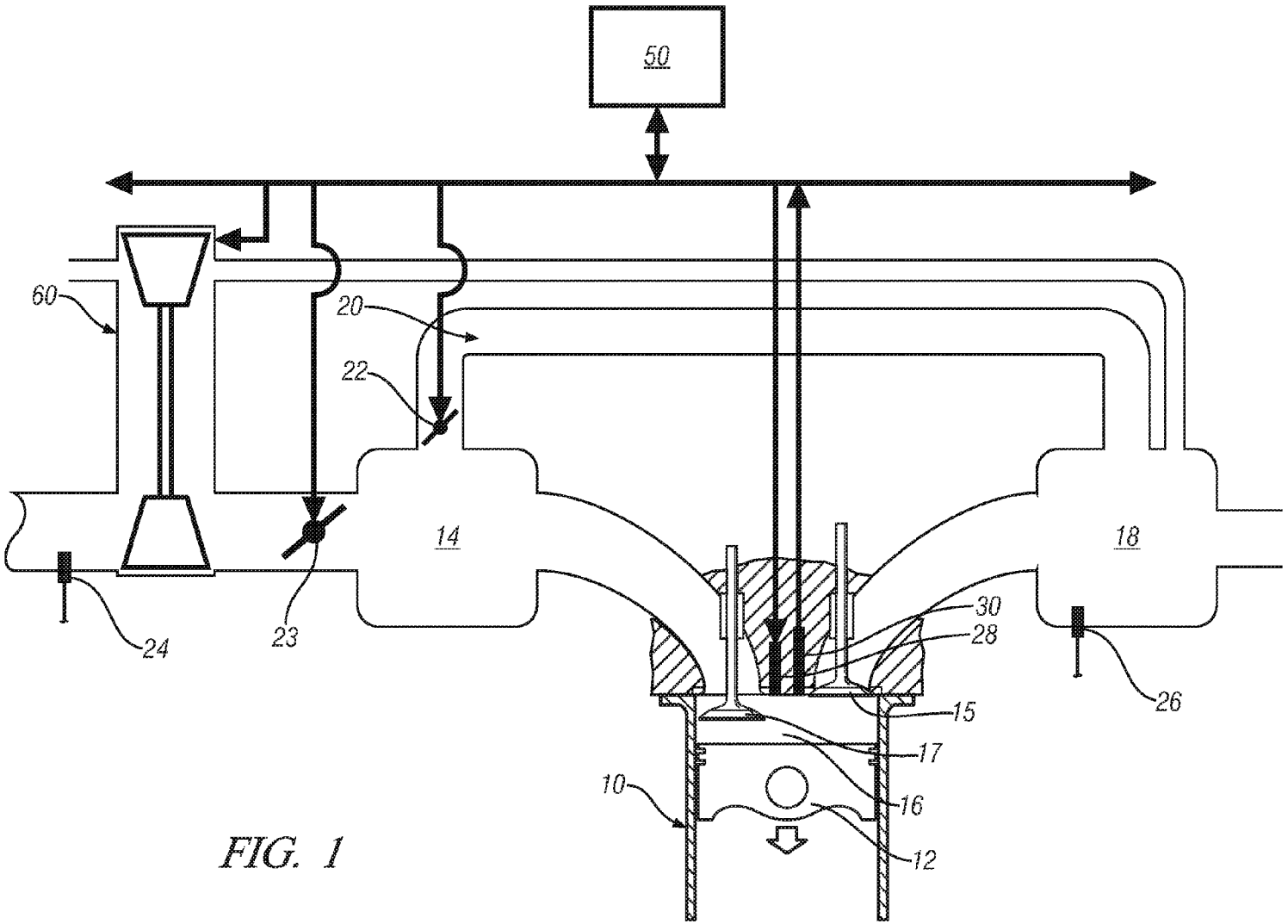
FIG. 1 schematically illustrates a portion of a single cylinder of a compression-ignition internal combustion engine, in accordance with the disclosure.

Referring now to the drawings, wherein the showings are for the purpose of illustrating certain exemplary embodiments only and not for the purpose of limiting the same, FIG. 1 schematically illustrates a portion of a single cylinder 12 of a compression-ignition internal combustion engine 10. The internal combustion engine 10 is configured to operate in a four-stroke combustion cycle including repetitively executed intake-compression-ignition-exhaust strokes, or any other suitable combustion cycle. The internal combustion engine 10 preferably includes an intake manifold 14, combustion chamber 16, intake and exhaust valves 17 and 15, respectively, an exhaust manifold 18, and an EGR system 20 including an EGR valve 22. The intake manifold 14 preferably includes a mass airflow sensor 24. The intake manifold 14 optionally includes a throttle 23 in one embodiment. The engine 10 also includes a controllable turbocharger 60 in one embodiment. An air/fuel ratio sensor 26 is configured to monitor an exhaust gas feedstream of the internal combustion engine 10. A fuel injector 28 is configured to directly inject fuel into the combustion chamber 16, which interacts with intake air and any internally retained or externally recirculated exhaust gases to form a cylinder charge. Pressure sensor(s) 30 is configured to monitor in-cylinder pressure in one of, or preferably all of the plurality of cylinders of the engine 10 during each combustion cycle. A single cylinder 12 is depicted, but it is appreciated that the engine 10 includes a plurality of cylinders. The subject matter described herein is not limited in application to the exemplary engine 10 described.

A control module 50 is signally connected to the air/fuel ratio sensor 26, the mass airflow sensor 24, and the pressure sensor(s) 30. The control module 50 is configured to execute control schemes to control operation of the engine 10 to form the cylinder charge in response to an operator command. The control module 50 is operatively connected to the fuel injector 28 and commands engine fueling, which may be a fuel pulse to deliver a volume of engine fuel to the combustion chamber 16 to form the cylinder charge in response an operator torque request in one embodiment. The fuel pulse is a commanded pulsewidth, or time period, during which the fuel injector 28 is commanded open to deliver the volume of engine fuel. The commanded pulsewidth is combined with the delivered volume of fuel and fuel density to achieve an injected fuel mass for a cylinder charge that is responsive to the operator torque request. It is appreciated that age, calibration, contamination and other factors may affect operation of the fuel injector 28, thus causing variations in the delivered fuel mass in response to a commanded fuel pulse. Variations between the commanded fuel pulse and the injected fuel mass may affect the in-cylinder air/fuel ratio of the cylinder charge. The control module 50 is operatively connected to the EGR valve 22 to command an EGR flowrate to achieve a preferred EGR fraction in the cylinder charge. It is appreciated that age, calibration, contamination and other factors may affect operation of the EGR system 20, thus causing variations in in-cylinder air/fuel ratio of the cylinder charge. The control module 50 is operatively connected to the throttle 23 to command a preferred fresh air mass flowrate for the cylinder charge. The control module 50 is operatively connected to the turbocharger 60 to command a preferred boost pressure associated with the cylinder charge.

Control module, module, controller, control unit, processor and similar terms mean any suitable one or various combinations of one or more of Application Specific Integrated Circuit(s) (ASIC), electronic circuit(s), central processing unit(s) (preferably microprocessor(s)) and associated memory and storage (read only, programmable read only, random access, hard drive, etc.) executing one or more software or firmware programs, combinational logic circuit(s), input/output circuit(s) and devices, appropriate signal conditioning and buffer circuitry, and other suitable components to provide the described functionality. The control module 50 has a set of control algorithms, including resident software program instructions and calibrations stored in memory and executed to provide the desired functions. The algorithms are preferably executed during preset loop cycles. Algorithms are executed, such as by a central processing unit, and are operable to monitor inputs from sensing devices and other networked control modules, and execute control and diagnostic routines to control operation of actuators. Loop cycles may be executed at regular intervals, for example each 3.125, 6.25, 12.5, 25 and 100 milliseconds during ongoing engine and vehicle operation. Alternatively, algorithms may be executed in response to occurrence of an event.

Engine fuel refers to fuel that is injected into the combustion chamber 16 in response to a commanded fuel pulse, and may be in the form of petrodiesel fuel, biodiesel fuel, or a blend of petrodiesel and biodiesel fuels. Characteristics of the engine fuel, including stoichiometric air/fuel ratio, density, heating value ($Q_{LHV}$), oxygen content, and Cetane number, vary with a varying blend ratio of petrodiesel and biodiesel fuels. As described and used herein, the blend ratio of petrodiesel and biodiesel fuels indicates a volumetric percentage of biodiesel fuel in a total sample volume of engine fuel in one embodiment. It is appreciated that other suitable metrics for blend ratios, e.g. mass/mass or mole/mole, may be employed to similar effect. As depicted with reference to FIGS. 2 and 3, the stoichiometric air/fuel ratio value and the heating value ($Q_{LHV}$) of the engine fuel both vary linearly with the blend ratio of petrodiesel and biodiesel fuels. Thus, it is appreciated that combustion parameters and work output of the engine 16 are affected by the characteristics of the engine fuel, which may vary depending upon a blend ratio of petrodiesel and biodiesel fuels.

Figure 2:
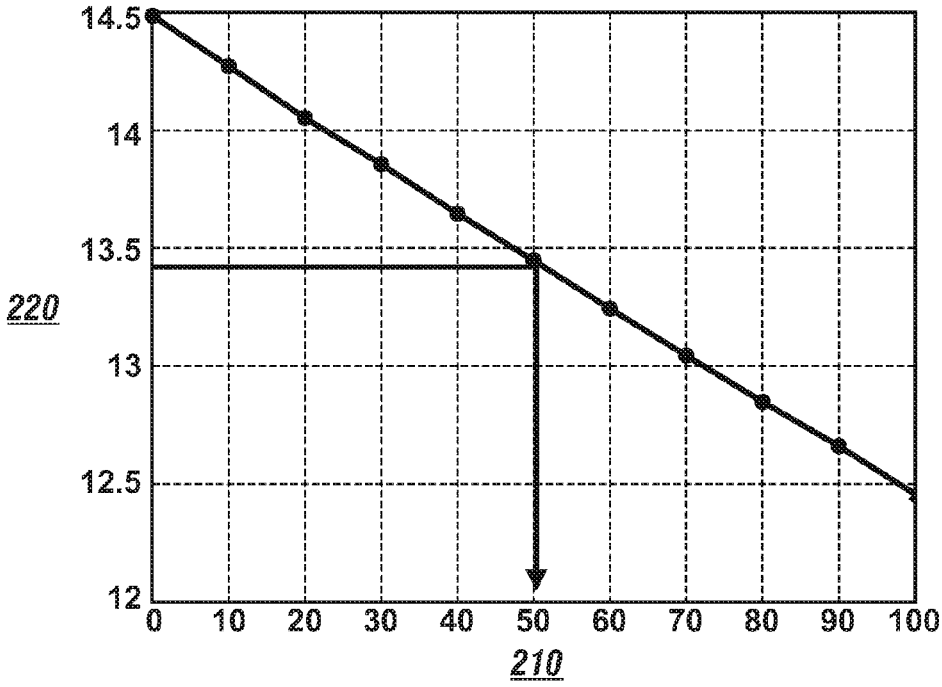
FIG. 2 graphically depicts a stoichiometric air/fuel ratio in relationship to a blend ratio of petrodiesel and biodiesel fuels, in accordance with the disclosure.

FIG. 2 graphically depicts a stoichiometric air/fuel ratio 220 in relationship to a blend ratio of petrodiesel and biodiesel fuels 210. The relationship indicates that the stoichiometric air/fuel ratio decreases linearly with increasing blend ratio of petrodiesel and biodiesel fuels, i.e., with increasing percentage of biodiesel fuel in the engine fuel. Thus, it is appreciated that the blend ratio may be determined from the stoichiometric air/fuel ratio in accordance with the linear relationship between the blend ratio and the stoichiometric air/fuel ratio.

Figure 3:
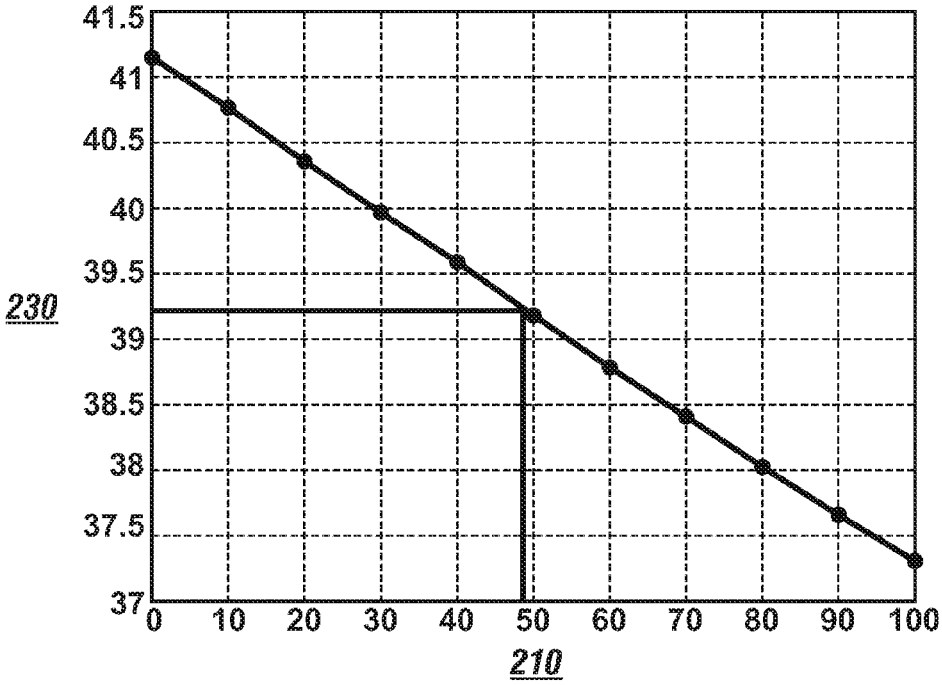
FIG. 3 graphically shows heating value ($Q_{LHV}$) of fuel in units of heat per fuel mass in relationship to the blend ratio of petrodiesel and biodiesel fuels, in accordance with the disclosure.

FIG. 3 graphically shows heating value ($Q_{LHV}$) of engine fuel 230 in units of heat per fuel mass (MJ/kg) in relationship to the blend ratio of petrodiesel and biodiesel fuels 210. The relationship indicates that the heating value ($Q_{LHV}$) decreases linearly with increasing blend ratio of petrodiesel and biodiesel fuels, i.e., decreases linearly with increasing percentage of biodiesel fuel in the blend ratio. Thus, it is appreciated that the blend ratio may be determined from the heating value ($Q_{LHV}$) in accordance with the linear relationship between the blend ratio and the heating value ($Q_{LHV}$).

A first method for determining the blend ratio of the petrodiesel and biodiesel fuels in the engine fuel of a cylinder charge includes determining a stoichiometric air/fuel ratio for the injected fuel mass by monitoring intake mass airflow using the mass airflow sensor 24, the air/fuel ratio using the air/fuel ratio sensor 26, and the commanded fuel pulse.

Model-based burned gas fraction dynamics are represented as follows:

$$\dot{F}_i = \frac{1}{m_i}(W_{egr}(F_x - F_i) - W_c F_i) \quad [1]$$

$$\dot{F}_x = \frac{1}{m_x}(W_{e,in}F_i - W_{e,out}F_x + (1 + AFR_s)W_f) \quad [2]$$

wherein the terms $\dot{F}_i$ and $\dot{F}_x$ indicate dynamic intake and exhaust gas mass burned fractions, respectively.

Steady state operating conditions may be used to analyze a single cylinder charge, which reduces EQS. 1 and 2 as follows:

$$F_i = F_x \cdot \frac{W_{egr}}{W_c + W_{egr}} \quad [3]$$

$$F_x = \frac{1 + AFR_s}{1 + W_c / W_f} \quad [4]$$

wherein $F_i$ is the intake gas mass burned fraction, $F_x$ is the exhaust gas mass burned fraction, $AFR_S$ is stoichiometric air/fuel ratio of the engine fuel in the cylinder charge, $W_{egr}$ is mass of exhaust gas flow through the EGR system 20 including the EGR valve 22 into the intake manifold 14, $W_c$ is mass of fresh air flow into the intake manifold 14 (through the compressor of the turbocharger 60 in the illustrated embodiment), and $W_f$ is the injected fuel mass in the cylinder charge.

The exhaust gas mass burned fraction $F_x$ is based on the oxygen concentration in the exhaust gas stream measured with the air/fuel ratio sensor 26. The mass of fresh air in the cylinder charge $W_c$ is measured and determined using the mass airflow sensor 24. The injected fuel mass in the cylinder charge $W_f$ may be determined using the commanded fuel pulse of the fuel injector 28 and other elements.

A stoichiometric air/fuel ratio for the engine fuel may be calculated for a known blend ratio, as follows:

$$AFR_{s,Bx} = \frac{AFR_{s,B100} * X * \delta_{B100} + AFR_{s,B0} * (1 - X)^* \delta_{B0}}{X * \delta_{B100} + (1 - X) * \delta_{B0}} \quad [5]$$

wherein $AFR_{S,Bx}$ indicates the stoichiometric air/fuel ratio for the engine fuel in the cylinder charge, X is the volumetric blend ratio of the petrodiesel and biodiesel fuels in one embodiment, wherein the term X indicates the volumetric percentage of biodiesel fuel in a total sample volume of fuel, $AFR_{s,B100}$ is the stoichiometric air/fuel ratio of biodiesel fuel, $\delta_{B100}$ is the density of biodiesel fuel, $AFR_{s,B0}$ is the stoichiometric air/fuel ratio of petrodiesel fuel, and $\delta_{B0}$ is the density of petrodiesel fuel.

The calculations in EQS. 4 and 5 require accurate understanding of the blend ratio X of the injected fuel mass, which requires information related to fuel density of the injected fuel mass. Thus, measurements of intake mass airflow using the mass airflow sensor 24, the air/fuel ratio using the air/fuel ratio sensor 26 and the commanded fuel pulse are used to determine a blend ratio of the petrodiesel and biodiesel fuels by way of the relation described with reference to EQ. 5. However, due to effects of part to part variation, aging and other factors, there is an injector gain factor between the commanded fuel pulse and the actual injected fuel mass which represents discrepancies between commanded fuel pulse and the actual injected fuel mass.

A second method for determining the blend ratio of the petrodiesel and biodiesel fuels includes determining a heat released in the cylinder charge and a corresponding heating value ($Q_{LHV}$) for the blend ratio of the petrodiesel and biodiesel fuels. The heat released in the cylinder charge is indicated by combustion heat release, and is a cumulative heat released for the cylinder charge, which corresponds to torque output or load which may be indicated by cylinder pressure (IMEP) generated during combustion. The heat released corresponds to the injected fuel mass in the cylinder charge and the heating value ($Q_{LHV}$) of the engine fuel. The heating value ($Q_{LHV}$) is a fuel-specific constant describing chemical energy content of the fuel per unit mass or volume. The combustion process turns chemical energy of the engine fuel into heat, which results in increased temperature and pressure in the cylinder. Combustion heat release is affected by the heating value ($Q_{LHV}$). The torque output or load (IMEP) that is generated by the combustion process is also affected. It is appreciated that a greater heating value ($Q_{LHV}$) results in greater amount of heat released at the end of combustion and/or greater IMEP. It is appreciated that a greater heating value ($Q_{LHV}$) results in greater amount of heat released for the injected fuel mass.

A heating value ($Q_{LHV}$) of the engine fuel in the cylinder charge is related to in-cylinder pressure. Combustion metrics associated with heating value ($Q_{LHV}$) in the cylinder charge include in-cylinder combustion pressure, which may include cylinder pressure measurements during compression and expansion strokes of an engine cycle and an indicated mean effective pressure (IMEP). As is appreciated, IMEP is a measure of the pressure volume or work per engine cycle and is measurable using the pressure sensor(s) 30.

The indicated mean effective pressure may be determined as follows:

$$IMEP = \frac{1}{V_{cyl}} \cdot \int P \cdot dV \quad [6]$$

wherein $V_{cyl}$ is cylinder volume, and

P is cylinder pressure.

In-cylinder temperature $T_k$ at a point in time k may be calculated or otherwise determined based upon pressure volume and specific heat, as follows:

$$T_k = \frac{P_k}{P_{ref}} \frac{V_k}{V_0} \left(\frac{V_0}{V_{ref}}\right)^{\gamma} T_0 \quad [7]$$

wherein $T_k$ is the combustion temperature at time k, $P_k$ is combustion pressure at time k, $V_0$ is cylinder volume at time 0, e.g. bottom-dead-center, $V_k$ is cylinder volume at time k; and $\gamma$ is a specific heat ratio of the engine fuel in the cylinder charge, which is a ratio of a specific heat of the fuel at constant volume and a specific heat of the fuel at constant pressure, i.e., $c_v/c_p$.

It is appreciated that k may represent time or crank angle degrees of rotation.

From this relation, combustion temperature during expansion due to piston motion $T_{exp}$ at a subsequent time (k+1) may be calculated as follows.

$$T_{exp} = T_k \cdot \left(\frac{V_k}{V_{k+1}}\right)^{\gamma - 1} \quad [8]$$

A heat release from time k to time k+1 is expressed as follows:

$$\Delta m_f \cdot Q_{LHV} = (m^* c_v, T_{k+1}^* T_{k+1} - m^* c_v, T_{exp}^* T_{exp}) \quad [9]$$

wherein $\Delta m_f \cdot Q_{LHV}$ is the heat released;

m is total fuel mass for the commanded fuel pulse, $T_{k+1}$ is combustion temperature at subsequent time k+1;

$c_v, T_{k+1}$ is heat capacity of the commanded fuel pulse at constant volume associated with the combustion temperature at subsequent time k+1, and $c_v, T_{exp}$ is heat capacity of the commanded fuel pulse at constant volume associated with the combustion temperature during expansion due to piston motion at subsequent time k+1.

From EQS. 7, 8 and 9, an amount of fuel burned $\Delta m_f$ during a time period may be calculated as follows:

$$\Delta m_f = \frac{V_{k+1}}{Q_{LHV}} \left\{ \frac{1}{(\gamma_{T_{k+1}} - 1)} \cdot P_{k+1} - \frac{1}{(\gamma_{T_{exp}} - 1)} \cdot P_k \cdot \left(\frac{V_k}{V_{k+1}}\right)^{\gamma_{T_k}} \right\} \quad [10]$$

wherein $Q_{LHV}$ indicates a heating value ($Q_{LHV}$) for the injected engine fuel in the cylinder charge.

Figure 4:
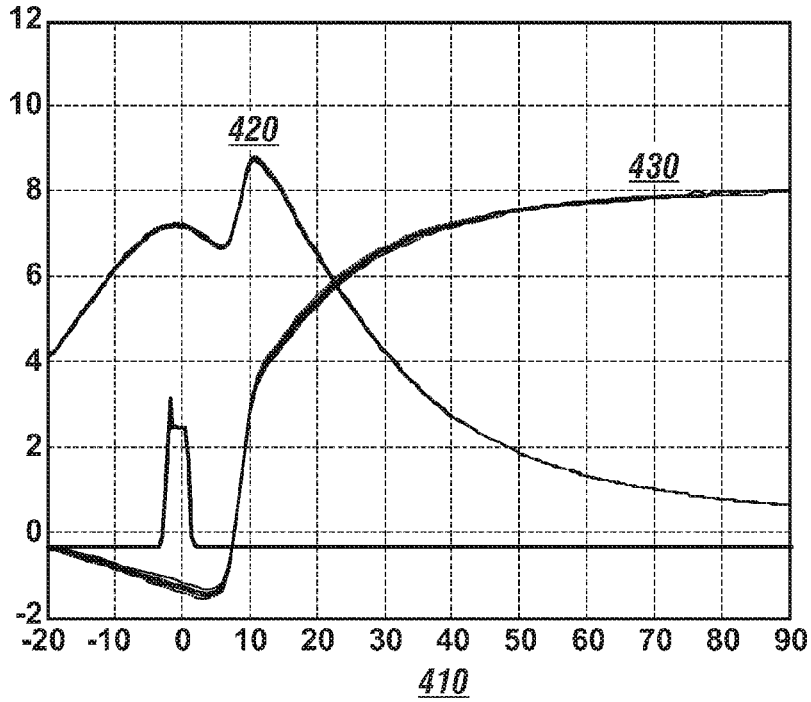
FIG. 4 graphically shows in-cylinder pressure and a scaled mass fraction burned plotted in relation to rotational engine position in crank angle degrees around TDC during an individual cylinder event, in accordance with the disclosure.

FIG. 4 graphically shows in-cylinder pressure 420 and a scaled mass fraction burned 430 plotted in relation to rotational engine position 410 in crank angle degrees around TDC during an individual cylinder event, which may be used to determine a percentage of total heat release during the individual cylinder event. The in-cylinder pressure 420 indicates the work during the compression and expansion strokes of individual cylinder event.

EQS. 6-10 provide an analytical basis for deriving a transfer function for calculating a normalized heat release corresponding to a commanded fuel pulse, which may be recursively calculated during an individual cylinder event and recursively calculated during successive cylinder events. The heat released is normalized by dividing by a total amount of heat released or by IMEP to remove variation associated with a sensor gain factor. The transfer function for calculating the normalized heat released corresponding to a commanded fuel pulse is expressed as follows:

$$z=c\cdot a\cdot u\cdot c\cdot a\cdot b+d \quad [11]$$

wherein z is a normalized heat release, c is proportional to a heating value ($Q_{LHV}$) of the fuel, u is the commanded fuel pulse in volume, e.g. ml, a is proportional to fuel density and fuel injector gain, d is heat loss or motoring IMEP, and b is a zero fuel pulsewidth.

A control scheme may be executed to calculate the heating value ($Q_{LHV}$) for the engine fuel in the cylinder charge using monitored inputs including the cylinder pressure and the commanded fuel pulse. This includes determining a magnitude for a zero fuel pulsewidth by skip-firing the cylinder and using a recursive least-squares analysis to determine a relation between a measured parameter, e.g. cylinder pressure, and a fuel heat value. Recursive least-squares analysis techniques are known.

The transfer function of EQ. 11 provides a relationship between a heat release term for a cylinder event ($z_{net}$) correlated to the heating value ($Q_{LHV}$) of the engine fuel, which may be expressed as follows:

$$z_{net}\propto Q_{LHV}*u*(\delta_{fuel}*g_{inj}) \quad [12]$$

wherein $z_{net}$ is a heat release term represented by either the cylinder pressure, e.g., IMEP, or the final value of heat released, each of which is preferably determined once per cylinder event, $Q_{LHV}$ is the heating value ($Q_{LHV}$) of the engine fuel used in the commanded fuel pulse, u is the commanded fuel pulse, $\delta_{fuel}$ is fuel density, and $g_{inj}$ is injector scaling.

It is appreciated that the relationship expressed in EQ. 12 may include other scalar terms related to mechanical efficiencies and/or thermal efficiencies and heat losses for a specific engine application. The relationship expressed in EQ. 12 indicates that the heating value ($Q_{LHV}$) of the engine fuel may be derived from a measured engine parameter that correlates to heat release for a cylinder event ($z_{net}$) such as the cylinder pressure, e.g., IMEP, or the final value of heat released. Thus, the heat release term for a cylinder event ($z_{net}$) may be used to indicate the blend ratio of the petrodiesel and biodiesel fuels.

Figure 5:
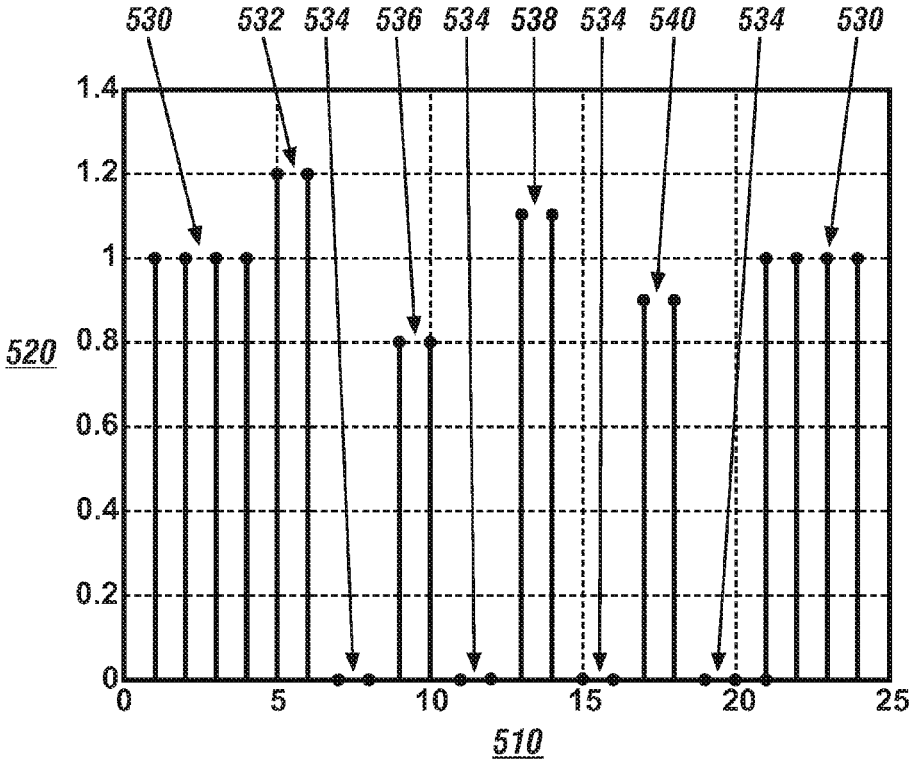
FIG. 5 graphically shows scaled commanded injector fuel pulses during successive combustion cycles during engine operation, in accordance with the disclosure.

FIG. 5 graphically depicts a series of scaled fuel pulses over successive combustion cycles 510 during engine operation, with scaling indicated by axis 520. A commanded pulsewidth 530 has a nominal value of 1.0, and commanded pulsewidths 532, 536, 538, and 540 are calculated percentages 120%, 80%, 110% and 90%, respectively, of the commanded pulsewidth 530. Measured parameters z, e.g. cylinder pressures, are measured during each of the successive combustion cycles. Pulsewidth 530 with corresponding measured parameter z0 indicates a nominal or commanded pulsewidth associated with an injected fuel mass for a cylinder charge that is responsive to an operator torque request. Alternatively, pulsewidth 530 with corresponding measured parameter z0 may be a no-fuel event. Each of commanded pulsewidths 532, 536, 538, and 540 are calculated percentages 120%, 80%, 110%, and 90% respectively, of the commanded pulsewidth 530, with corresponding cylinder pressure measurements z1, z2, z3, and z4. The pulsewidth 534 and corresponding cylinder pressure measurement z0 represent a commanded zero fuel pulse to effect a common mode rejection of cylinder pressure. The cylinder pressure measurement z0 is subtracted from each of the cylinder pressure measurements z1, z2, z3, and z4 to calculate the net cylinder pressure $z_{net}$, which is used in EQ. 12, above in a recursive, least-square analysis to calculate the heating value ($Q_{LHV}$) of the engine fuel. In one embodiment, the recursive, least-square analysis of the commanded pulsewidths 532, 536, 538, and 540 and corresponding cylinder pressure measurements z1, z2, z3, and z4 is used to generate a linear function having a slope that corresponds to the heating value ($Q_{LHV}$) of the engine fuel. Thus, when the heating value ($Q_{LHV}$) of engine fuel is known, the blend ratio of petrodiesel and biodiesel fuels may be determined using the relationship depicted in FIG. 3. Again, however, due to effects of part to part variation, aging and other factors, there is an injector gain factor between the commanded fuel pulse and the actual injected fuel mass.

Thus, the first relation described with reference to EQS. 1-5 is used to determine a blend ratio of the petrodiesel and biodiesel fuels from inputs including the mass airflow sensor 24, the air/fuel ratio sensor 26, and the commanded fuel pulse, which is based upon the stoichiometric air/fuel ratio. However, given the disparity in actual fuel mass versus commanded fuel pulse as discussed above due to effects of part to part variation, aging and other factors, such fuel injector variability may be treated as an unknown. Therefore, a more accurate solution for the stoichiometric air/fuel ratio of the engine fuel in the cylinder charge $AFR_S$ remains unknown.

The second relation described with reference to EQS. 6-12 is used to determine a blend ratio of the petrodiesel and biodiesel fuels from inputs including the cylinder pressure and the commanded fuel pulse, which is based upon extracting the heating value ($Q_{LHV}$) of the engine fuel. Again, however, given the disparity in actual fuel mass versus commanded fuel pulse as discussed above due to effects of part to part variation, aging and other factors, such fuel injector variability may be treated as an unknown. Therefore, a more accurate solution for the heating value ($Q_{LHV}$) for the injected engine fuel in the cylinder charge remains unknown.

The blend ratio of the petrodiesel and biodiesel fuels determined using the stoichiometric air/fuel ratio and the blend ratio of the petrodiesel and biodiesel fuels determined using the heat released and the heating value ($Q_{LHV}$) are recursively determined during ongoing engine operation.

The blend ratio determined using the stoichiometric air/fuel ratio and the blend ratio determined using the heat released and the heating value ($Q_{LHV}$) of engine fuel have a common unknown element, i.e., the relationship between the commanded fuel pulse and the injected fuel mass. Both determinations exhibit limited accuracy due to disparity in actual fuel mass delivered versus commanded fuel pulse. However, given that both determinations seek solutions to the same blend ratio and both determinations share the same unknown injector disparity, both determinations may be used cooperatively to robustly solve both the blend ratio and the injected fuel mass. A Kalman filter or other suitable analytical device may be applied to determine the blend ratio of the petrodiesel and biodiesel fuels using information obtained from the first and second relationships.

In one embodiment, the control module 50 may execute a control scheme that uses the blend ratio of petrodiesel and biodiesel fuels in combination with the estimated stoichiometric air/fuel ratio of the engine fuel to control engine operation. Commanded values for EGR flowrate (EGR_rate_cmd), intake air (Fresh_air_cmd), and turbocharger boost pressure (Boost_cmd) are determined in response to predetermined relationships f1, f2, and f3, respectively, which are associated with injected fuel mass (fuel_mass_cmd) and engine speed (rpm) using 100% petrodiesel fuel. The predetermined relationships are executed as calibration tables, function equations, or other suitable engine control schemes. In operation, the injected fuel mass (fuel_mass_cmd) is adjusted by a ratio of a stoichiometric air/fuel ratio of 100% petrodiesel fuel (AFRs1) and the estimated stoichiometric air/fuel ratio of the engine fuel, which may be a blend of the petrodiesel and biodiesel fuels (AFRs2). The commanded values associated with the predetermined relationships include the following.

$$EGR_rate_cmd = f1(rpm,(AFRs2/AFRs1)fuel_mass_cmd) \quad [13]$$

$$Fresh_air_cmd = f2(rpm,(AFRs2/AFRs1)fuel_mass_cmd) \quad [14]$$

$$Boost_cmd = f3(rpm,(AFRs2/AFRs1)fuel_mass_cmd) \quad [15]$$

In an embodiment having only the exhaust gas oxygen sensor, the control module 50 may execute a control scheme to determine a parameter associated with blend ratio of the petrodiesel and biodiesel fuels for controlling operation of the engine. The parameter associated with the blend ratio of the petrodiesel and biodiesel fuels and control engine operation may be an estimated heating value ($Q_{LHV}$) of the engine fuel.

In one embodiment, the control module 50 may execute a control scheme that uses an estimated heating value ($Q_{LHV}$) for the engine fuel corresponding to the in-cylinder pressure to determine a blend ratio of petrodiesel and biodiesel fuels to control engine operation. Commanded values for EGR flowrate (EGR_rate_cmd), intake air (Fresh_air_cmd), and turbocharger boost pressure (Boost_cmd) are determined in response to predetermined relationships f1, f2, and f3, respectively, which are associated with injected fuel mass (fuel_mass_cmd) and engine speed (rpm). The predetermined relationships are executed as calibration tables, function equations, or other suitable engine control schemes. In operation, the injected fuel mass (fuel_mass_cmd) is adjusted by a ratio of the estimated heating value ($Q_{LHV}$) of 100% petrodiesel fuel (LHV 1) and the estimated heating value ($Q_{LHV}$) for the engine fuel, which may be a blend of the petrodiesel and biodiesel fuels (LHV 2). The commanded values associated with the predetermined relationships include the following.

$$EGRrate_cmd = f1(rpm,(LHV2/LHV1)fuel_mass_cmd) \quad [16]$$

$$Fresh_air_cmd = f2(rpm,(LHV2/LHV1)fuel_mass_cmd) \quad [17]$$

$$Boost_cmd = f3(rpm,(LHV2/LHV1)fuel_mass_cmd) \quad [18]$$

In an embodiment having only a single cylinder pressure sensor, the control module 50 may execute a control scheme that monitors a signal output from the single cylinder pressure sensor and determines IMEP therefrom. The IMEP is used to determine a heat released in the cylinder charge, which may be used in combination with the mass of injected engine fuel to determine the heating value ($Q_{LHV}$) of the engine fuel, which may be used to determine a blend ratio of the petrodiesel and biodiesel fuels. Thus, a single parameter may be used to determine a blend ratio of the petrodiesel and biodiesel fuels and to control engine operation based thereon. A plurality of cylinder pressure sensors may serve to increase robustness of the pressure measurement and associated determination of the blend ratio.

The control scheme is able to automatically adjust itself in response to variations in the blend ratio of petrodiesel and biodiesel fuels and counteract other compounding effects in blend estimation, such as variability of delivery of fuel from an injector. This control scheme permits fuel blend estimation despite injector variability, which is a common compounding effect on both measurements.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Method for controlling operation of an internal combustion engine configured to combust fuel in a compression-ignition combustion mode, comprising:

monitoring oxygen concentration in an exhaust gas feedstream of the internal combustion engine, mass flowrate of intake air, and a commanded fuel pulse of the fuel;

determining a stoichiometric air/fuel ratio of the fuel based on the oxygen concentration in the exhaust gas feedstream, the mass flowrate of intake air, and the commanded fuel pulse;

determining a first blend ratio of biodiesel fuel and petrodiesel fuel of the fuel correlated to the stoichiometric air/fuel ratio of the fuel; and controlling engine operation in response to the first blend ratio of biodiesel fuel and petrodiesel fuel of the fuel;

wherein determining the stoichiometric air/fuel ratio of the fuel based on the oxygen concentration in the exhaust gas feedstream, the mass flowrate of intake air, and the commanded fuel pulse comprises determining the stoichiometric air/fuel ratio in accordance with the following relationship:

$$F_x = \frac{1 + AFR_s}{1 + W_c / W_f}$$

wherein $F_x$ is an exhaust gas mass burned fraction determined based on the oxygen concentration in the exhaust gas feedstream, $AFR_S$ is the stoichiometric air/fuel ratio of the engine fuel, $W_c$ is a mass of fresh air flow into an intake manifold of the engine determined based on the mass flowrate of intake air, and $W_f$ is an injected fuel mass determined based on the commanded fuel pulse.

2. The method of claim 1, wherein controlling engine operation in response to the first blend ratio of biodiesel fuel and petrodiesel fuel of the fuel comprises controlling a commanded EGR flowrate in response to the first blend ratio of biodiesel fuel and petrodiesel fuel of the fuel.

3. The method of claim 1, wherein controlling engine operation in response to the first blend ratio of biodiesel fuel and petrodiesel fuel of the fuel comprises controlling a commanded fresh air flowrate in response to the first blend ratio of biodiesel fuel and petrodiesel fuel of the fuel.

4. The method of claim 1, wherein controlling engine operation in response to the first blend ratio of biodiesel fuel and petrodiesel fuel of the fuel comprises controlling a commanded boost pressure in response to the first blend ratio of biodiesel fuel and petrodiesel fuel of the fuel.

5. Method for controlling operation of an internal combustion engine configured to combust fuel in a compression-ignition combustion mode, comprising:

monitoring oxygen concentration in an exhaust gas feedstream of the internal combustion engine, mass flowrate of intake air, and a commanded fuel pulse of the fuel;

determining a stoichiometric air/fuel ratio of the fuel based on the oxygen concentration in the exhaust gas feedstream, the mass flowrate of intake air, and the commanded fuel pulse;

determining a first blend ratio of biodiesel fuel and petrodiesel fuel of the fuel correlated to the stoichiometric air/fuel ratio of the fuel;

monitoring in-cylinder pressure;

determining a heating value of the fuel based on the in-cylinder pressure and the commanded fuel pulse;

determining a second blend ratio of biodiesel fuel and petrodiesel fuel of the fuel correlated to the heating value of the fuel; and controlling engine operation in response to the first blend ratio of biodiesel fuel and petrodiesel fuel of the fuel and in response to the second blend ratio of biodiesel fuel and petrodiesel fuel of the fuel.

6. The method of claim 5, wherein controlling engine operation in response to the first and second blend ratios of biodiesel fuel and petrodiesel fuel of the fuel comprises controlling a commanded EGR flowrate in response to the first and the second blend ratios of biodiesel fuel and petrodiesel fuel of the fuel.

7. The method of claim 5, wherein controlling engine operation in response to the first and second blend ratios of biodiesel fuel and petrodiesel fuel of the fuel comprises controlling a commanded fresh air flowrate in response to the first and the second blend ratios of biodiesel fuel and petrodiesel fuel of the fuel.

8. The method of claim 5, wherein controlling engine operation in response to the first and second blend ratios of biodiesel fuel and petrodiesel fuel of the fuel comprises controlling a commanded boost pressure in response to the first and the second blend ratios of biodiesel fuel and petrodiesel fuel of the fuel.

9. The method of claim 5, wherein determining the heating value of the fuel based upon the in-cylinder pressure and the commanded fuel pulse comprises determining the heating value of the fuel corresponding to the in-cylinder pressure and the commanded fuel pulse in accordance with the following relationship:

$$z_{net} \propto Q_{LHV} * u * (\delta_{fuel} * g_{inj})$$

wherein $z_{net}$ is the in-cylinder pressure, $Q_{LHV}$ is the heating value of the fuel used in the commanded fuel pulse, u is the commanded fuel pulse, $\delta_{fuel}$ is fuel density, and $g_{inj}$ is injector scaling.

10. Method for controlling operation of an internal combustion engine configured to operate in a compression-ignition combustion mode, comprising:

monitoring in-cylinder pressure;

determining a heating value of the fuel based on the in-cylinder pressure and a commanded fuel pulse in accordance with the following relationship:

$$z_{net} \propto Q_{LHV} * u * (\delta_{fuel} * g_{inj})$$

wherein $z_{net}$ is the in-cylinder pressure, $Q_{LHV}$ is the heating value of the fuel used in the commanded fuel pulse, u is the commanded fuel pulse, $\delta_{fuel}$ is fuel density, and $g_{inj}$ is injector scaling;

determining a blend ratio of biodiesel fuel and petrodiesel fuel of the fuel correlated to the heating value of the fuel; and controlling engine operation in response to the blend ratio of biodiesel fuel and petrodiesel fuel of the fuel.

11. The method of claim 10, wherein controlling engine operation in response to the blend ratio of biodiesel fuel and petrodiesel fuel of the fuel comprises controlling a commanded EGR flowrate in response to the blend ratio of biodiesel fuel and petrodiesel fuel of the fuel.

12. The method of claim 10, wherein controlling engine operation in response to the blend ratio of biodiesel fuel and petrodiesel fuel of the fuel comprises controlling a commanded fresh air flowrate in response to the blend ratio of biodiesel fuel and petrodiesel fuel of the fuel.

13. The method of claim 10, wherein controlling engine operation in response to the blend ratio of biodiesel fuel and petrodiesel fuel of the fuel comprises controlling a commanded boost pressure in response to the blend ratio of biodiesel fuel and petrodiesel fuel of the fuel.

14. Method for operating an internal combustion engine configured to combust fuel in a compression-ignition combustion mode, comprising:

determining a heating value of fuel based on in-cylinder pressure and commanded engine fueling;

determining a stoichiometric air/fuel ratio of the fuel based on an oxygen concentration in the exhaust gas feedstream, a mass flowrate of intake air, and the commanded engine fueling;

determining a first blend ratio of biodiesel fuel and petrodiesel fuel correlated to the stoichiometric air/fuel ratio of the fuel;

determining a second blend ratio of biodiesel fuel and petrodiesel fuel correlated to the heating value of the fuel; and controlling engine operation in response to the first and second blend ratios of biodiesel fuel and petrodiesel fuel.

15. The method of claim 14, wherein monitoring in-cylinder pressure comprises monitoring in-cylinder combustion pressure during compression and expansion strokes of an engine cycle.

16. The method of claim 15, wherein determining the heating value of the fuel based upon the in-cylinder pressure and the commanded fuel pulse comprises determining the heating value of the fuel corresponding to the in-cylinder pressure and the commanded fuel pulse in accordance with the following relationship:

$$z_{net} \propto Q_{LHV} * u * (\delta_{fuel} * g_{inj})$$

wherein $z_{net}$ is the in-cylinder pressure, $Q_{LHV}$ is the heating value of the fuel used in the commanded fuel pulse, u is the commanded fuel pulse, $\delta_{fuel}$ is fuel density, and $g_{inj}$ is injector scaling.

17. The method of claim 16, wherein determining the stoichiometric air/fuel ratio of the fuel based on the oxygen concentration in the exhaust gas feedstream, the mass flowrate of intake air, and the commanded fuel pulse comprises determining the stoichiometric air/fuel ratio in accordance with the following relationship:

$$F_x = \frac{1 + AFR_s}{1 + W_c / W_f}$$

wherein $F_x$ is an exhaust gas mass burned fraction determined based on the oxygen concentration in the exhaust gas feedstream, $AFR_S$ is the stoichiometric air/fuel ratio of the engine fuel, $W_c$ is a mass of fresh air flow into an intake manifold of the engine determined based on the mass flowrate of intake air, and $W_f$ is an injected fuel mass determined based on the commanded fuel pulse.

18. The method of claim 14, wherein determining the stoichiometric air/fuel ratio of the fuel based on the oxygen concentration in the exhaust gas feedstream, the mass flowrate of intake air, and the commanded fuel pulse comprises determining the stoichiometric air/fuel ratio in accordance with the following relationship:

$$F_x = \frac{1 + AFR_s}{1 + W_c / W_f}$$

wherein $F_x$ is an exhaust gas mass burned fraction determined based on the oxygen concentration in the exhaust gas feedstream, $AFR_S$ is the stoichiometric air/fuel ratio of the engine fuel, $W_c$ is a mass of fresh air flow into an intake manifold of the engine determined based on the mass flowrate of intake air, and $W_f$ is an injected fuel mass determined based on the commanded fuel pulse.

* * * * *